US009244401B2

(12) United States Patent
Kitadai et al.

(10) Patent No.: US 9,244,401 B2
(45) Date of Patent: Jan. 26, 2016

(54) IMAGE FORMING APPARATUS

(75) Inventors: Goichi Kitadai, Suntou-gun (JP); Daisuke Miyagawa, Mishima (JP); Noriyuki Ito, Mishima (JP); Takahiro Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 590 days.

(21) Appl. No.: 12/607,007

(22) Filed: Oct. 27, 2009

(65) Prior Publication Data

US 2010/0104340 A1 Apr. 29, 2010

(30) Foreign Application Priority Data

Oct. 28, 2008 (JP) ..... 2008-276985

(51) Int. Cl.
*G03G 15/00* (2006.01)
*G03G 15/20* (2006.01)

(52) U.S. Cl.
CPC ..... *G03G 15/2042* (2013.01)

(58) Field of Classification Search
CPC ..... G03G 15/2042; G03G 13/20
USPC ..... 399/122, 320, 322, 67, 69, 33
See application file for complete search history.

(56) References Cited

U.S. PATENT DOCUMENTS 6,713,725 B2 * 3/2004 Izawa et al. ..... 219/216
2003/0190170 A1 * 10/2003 Hamada et al. ..... 399/69
2004/0081491 A1 * 4/2004 Uchida et al. ..... 399/328
2005/0031363 A1 * 2/2005 Nishi ..... 399/69
2006/0062610 A1 * 3/2006 Ito et al. ..... 399/328

FOREIGN PATENT DOCUMENTS

| | | |
|---|---|---|
| JP | 4-237084 | 8/1992 |
| JP | 04237084 A | 8/1992 |
| JP | 5-265350 | 10/1993 |
| JP | 6-3983 | 1/1994 |
| JP | 2007-199524 | 8/2007 |

* cited by examiner

*Primary Examiner* — Matthew G Marini
(74) *Attorney, Agent, or Firm* — Canon U.S.A., Inc. IP Division

(57) ABSTRACT

In an image forming apparatus, the overall length of a heat generating resistor is set longer than the width of a recording paper, which is the greatest of widths of standard size recording papers that can be used on the image forming apparatus. An electrical resistance of an edge area of the heat generating resistor per unit length is set smaller than that of a center area of the heat generating resistor. The position of a boundary between the center area and the edge area is set so that the position of the side edge of the recording paper whose width is the greatest exists within the edge area and so that if the recording paper having the second greatest width is fed by a one edge-aligned paper feeding method, the position of the side edge of a recording paper whose width is the greatest of the widths of the standard size recording papers that can be used on the image forming apparatus except the width of the recording paper that is the greatest thereof is set at a position within the center area.

12 Claims, 13 Drawing Sheets

IMAGE FORMING APPARATUS

BACKGROUND OF THE INVENTION

1. Field of the Invention

The present invention relates to an image forming apparatus. More specifically, the present invention relates to an image forming apparatus, which includes a heater having a heat generating resistor provided on a substrate thereof and a fixing film configured to rotate while being in contact with the heater, and configured to thermally fix a tone image formed on a recording paper by the heat from the heater applied via the fixing film onto a recording paper.

2. Description of the Related Art

A film type fixing unit has been widely used as a fixing unit of an electrophotographic copying machine or a printer, which includes a heater having a heat generating resistor provided on a ceramic substrate, a film (flexible member) configured to move while being in contact with the heater, and a pressure roller configured to form a nip portion with the heater via the film.

A film type fixing unit thermally fixes a toner image formed on a recording paper onto the recording paper by pinching and conveying a recording paper bearing an unfixed toner image into a nip portion of the fixing unit and applying heat to the toner image on the recording paper. In the above-described fixing unit, the time taken from the start of supply of power to the heater to the timing at which the temperature of the heater reaches a fixable temperature is short. Accordingly, in a printer including the above-described fixing unit, the time taken from the timing of input of a printing command to the timing of output of the first image (a first print out time (FPOT)) is short. In addition, the power consumption of the printer consumed during waiting for a printing command is small.

In an image forming apparatus including the above-described film type fixing unit, when printing on a small size paper such as a postcard, whose width is smaller than a maximum printable recording paper width, the film type fixing unit may damage the film or the pressure roller if the temperature of the fixing unit is excessively raised because of the temperature rise in an area of the heater through which no recording paper passes (a non-paper-passage area) (i.e., if a phenomenon so-called "temperature rise of non-paper passage area" occurs).

Japanese Patent Application Laid-Open No. 04-237084 discusses that if the magnitude of the heat generating quantity per unit length is reverse to the magnitude of the nip width in a longitudinal direction of the heater, then the temperature rise in the non-paper-passage area, which may occur when a small size paper is fed, can be effectively reduced.

Meanwhile, standard size papers of various sizes are used in different countries and regions. In North America, a letter (LTR) size paper (approximately 8.5×11 inches (≈216×279 mm)) is widely used. Accordingly, in North America, an image forming apparatus in which the width of the LTR size paper is set as the maximum printable recording paper width is used.

On the other hand, In Europe and Asia, an A4 size paper (210×297 mm), whose width is smaller than that of the LTR size paper, is widely used. Accordingly, in Europe and Asia, an image forming apparatus in which the width of the A4 size paper is set as the maximum printable recording paper width is used.

Under these circumstances, in order to achieve commonality of the type of an image forming apparatus to be distributed within various countries and regions and reduce the costs thereof, the image forming apparatus in which the size of the LTR size paper is set as the maximum printable recording paper width, which is used in North America, is also used in European and Asian countries and regions.

When printing is performed on an A4 size paper with an image forming apparatus adaptable to the LTR size paper, the temperature rise in non-paper passage areas may occur. The temperature may not exceed the heat resistant temperatures of the parts and components of the fixing unit if printing is executed at a conventional printing speed even when the temperature rise in non-paper passage areas occurs. However, in recent years, the heat capacity of a fixing unit has been decreased and the fixing unit has been configured to have a heat-insulated structure in order to save energy consumption, while the fixation temperature has been raised to increase the printing speed.

Accordingly, if the printing speed is set to a speed higher than the printing speed of a currently marketed image forming apparatus, if an A4 size paper is used for an image forming apparatus in which the size of the LTR size paper is set as the maximum printable recording paper width, the temperature of the non-paper-passage area may rise to a temperature higher than the heat resistance temperature of the part and components of the fixing unit.

The temperature rise in non-paper passage areas may become particularly serious in executing one edge-aligned paper passage, in which an A4 size paper is fed aligned with one edge of the paper passage area in a state in which a recording paper position regulation member of a paper cassette is set to the size of the LTR size paper. In this case, the film or the pressure roller may be damaged.

The one edge-aligned paper passage will be described in detail below. When setting a paper on a paper feed cassette, a user of the image forming apparatus sets two recording paper position regulation members, which are provided opposite each other, according to the size of the paper to be used to regulate both side edges of the paper in the lateral (widthwide) direction. By regulating the position of the paper in the widthwide direction, an image can be formed on an appropriate position on the paper.

FIG. 13 illustrates a positional relationship between the heater and the paper in the longitudinal direction and the widthwide direction.

In printing on an A4 size paper, the user sets the recording paper position regulation member to the position of the A4 size paper (to a position P2 in FIG. 13). Accordingly, the position of the paper in the widthwide direction is regulated. Thus, the edge of the A4 size paper is fed aligned to a position approximately 3 mm closer to the center of the surface of the heater compared to the position of passage of the edge of an LTR size paper P1. In this case also, the temperature of the non-paper-passage area of the heater may slightly rise, but the temperature may not be excessively raised to a high temperature at which the film or the pressure roller may be damaged.

However, in printing on an A4 size paper, if the user sets the recording paper position regulation member aligned to the size of an LTR size paper (at a position P3 or P4 in FIG. 13) by mistake and if the paper is fed in a state in which the side edge of the paper contacts either one of the two recording paper position regulation members, then the non-paper-passage area becomes large. Accordingly, in this case, the temperature of the heater may easily become very high.

In order to prevent the above-described phenomenon, it may be useful in reducing the temperature rise in non-paper passage areas to reduce the length of the heat generating resistor in the non-paper-passage area. However, if the length of the heat generating resistor in the non-paper-passage area is reduced to be very short, the fixing property on the edge of an LTR size paper may degrade.

In addition, by reducing the speed of conveyance of a recording paper (i.e., by taking a large distance between printing papers), the temperature rise in non-paper passage areas may be reduced. However, in this case, because the printing speed decreases, the convenience of users in European and Asian countries or regions, who often use an A4 size paper, may degrade.

The problem may occur not only in an image forming apparatus in which the size of the LTR size paper is set as the maximum printable standard size paper width but also in an image forming apparatus in which the size of a paper other than an LTR size paper is set as the maximum printable standard size paper width.

More specifically, the above-described problem may occur if printing on a ledger size paper (11×17 inches (≈279×432 mm)), which is often used in North American countries or regions, is executed with an image forming apparatus in which the size of an A3 size paper (297×420 mm), which is often used in European or Asian countries or regions, is set as the maximum printable standard size paper width.

SUMMARY OF THE INVENTION

The present invention is directed to an image forming apparatus capable of suppressing or alleviating excessive rise in the temperature of non-paper-passage areas, which may occur when a paper, whose width is the greatest of widths of papers that can be used on the image forming apparatus except the width of a paper set as a maximum printable recording paper width, is fed by one edge-aligned paper passage, without degrading the fixing property of the recording paper having the width equivalent to the maximum printable standard size paper width.

According to an aspect of the present invention, an image forming apparatus configured to form a toner image on a recording paper includes an image forming unit configured to form an unfixed toner image on the recording paper, a paper feed unit configured to feed the recording paper to be conveyed into the image forming unit, the paper feed unit including a recording paper position regulation member configured to move in a direction perpendicular to a recording paper conveyance direction, and a fixing unit configured to fix the unfixed toner image formed on the recording paper thereon, the fixing unit including an endless belt, a heater including a heat generating resistor on a substrate thereof and configured to be in contact with an inner surface of the endless belt, and a pressure roller configured to form a fixing nip portion with the heater via the endless belt. In the fixing unit of the image forming apparatus a length of the heat generating resistor in the direction perpendicular to the recording paper conveyance direction is set longer than a width of a recording paper of a first size, which has a width that is the greatest of widths of standard size recording papers that can be used on the image forming apparatus. Furthermore, in the fixing unit of the image forming apparatus, in the direction perpendicular to the recording paper conveyance direction, a resistance of the heat generating resistor per unit length is set smaller in an edge area than in a center area. Moreover, in the fixing unit of the image forming apparatus, if one edge of a recording paper of a second size, whose width is the greatest of the widths of the standard size recording papers except the width of the first size recording paper, is aligned to the recording paper position regulation member when the recording paper position regulation member is set at a position for feeding the first size recording paper, a boundary position at which the resistance varies is set within an area existing between a position of the other edge of the second size recording paper and a position of the recording paper position regulation member positioned at the position for feeding the first size recording paper.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

DESCRIPTION OF THE EMBODIMENTS

Various exemplary embodiments, features, and aspects of the invention will be described in detail below with reference to the drawings.

Figure 12:
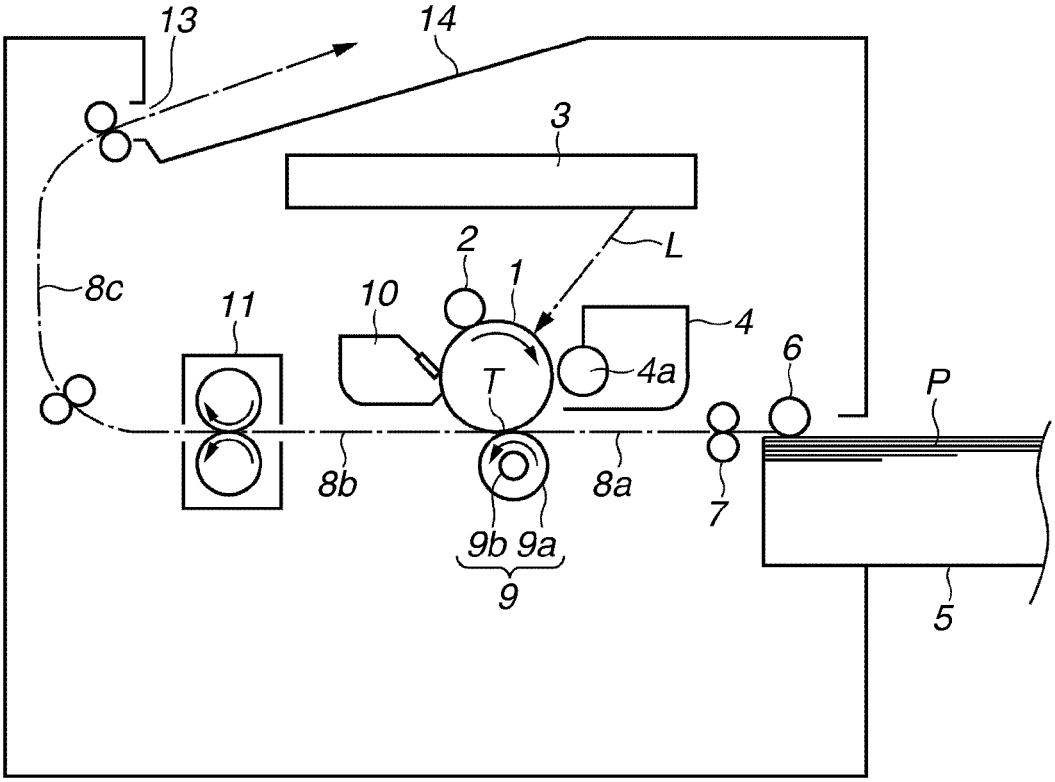
FIG. 12 illustrates an exemplary configuration of an image forming apparatus according to an exemplary embodiment of the present invention.

FIG. 12 illustrates an exemplary configuration of an image forming apparatus according to a first exemplary embodiment of the present invention. The image forming apparatus is a laser beam type printer that uses an electrophotographic recording method.

Referring to FIG. 12, an electrophotographic photosensitive member 1 is a rotational drum-type image bearing member (hereinafter simply referred to as a photosensitive drum). The photosensitive drum 1 rotates in a direction indicated with an arrow in FIG. 12 at a predetermined peripheral speed. The photosensitive drum 1 includes a photosensitive member made of organic photoconductor (OPC) or amorphous silicon formed on a cylinder-like substrate made of aluminum or nickel.

An outer circumferential surface (the surface) of the photosensitive drum 1 is evenly charged by a charging roller (charging device) 2 during rotation. A laser beam scanner 3 scans the surface of the photosensitive drum 1, which is evenly charged, with a laser beam L, which is modulated according to image information. Accordingly, an electrostatic latent image is formed on the surface of the photosensitive drum 1 according to the image information. The electrostatic latent image is developed (converted into a visible image) by a development device 4 as a toner image with toner (developer).

A recording paper P, which is a heating target material, is separated and fed sheet by sheet from a recording paper bundle on a paper feed cassette 5 to a registration roller 7 by a paper feed roller 6.

The timing of conveying the recording paper P is synchronized with the rotation of the photosensitive drum 1 to the timing the toner image formed on the surface of the photosensitive drum 1 comes to a transfer nip portion T by the registration roller 7. More specifically, the registration roller 7 conveys the recording paper P into the transfer nip portion T via a sheet path 8*a*. The transfer nip portion T exists between the photosensitive drum 1 and a transfer roller 9. In other words, the registration roller 7 adjusts the timing of conveying the recording paper P so that the leading edge of the recording paper P reaches the transfer nip portion T when the leading edge of the toner image formed on the surface of the photosensitive drum 1 reaches the transfer nip portion T.

After being conveyed to the transfer nip portion T, the recording paper P is pinched and conveyed by the transfer nip portion T. During the pinching and conveying operation by the transfer nip portion T, a transfer bias having a polarity opposite to the polarity of the toner is applied from a transfer bias applying power source (not illustrated). The toner image on the surface of the photosensitive drum 1 is electrostatically transferred onto the recording paper P by the effect of the transfer bias. The photosensitive drum 1, the charging roller 2, the laser beam scanner 3, the development device 4, and the transfer roller 9 constitute an image forming unit configured to form an unfixed toner image onto the recording paper.

After the toner image is transferred onto the recording paper P in the transfer nip portion T, the recording paper P having the unfixed toner image is separated from the surface of the photosensitive drum 1 to a fixing unit 11 via a sheet path 8*b*. The fixing unit 11 thermally fixes the toner image on the recording paper P. After passing through the fixing unit 11, the recording paper P is guided into a sheet path 8*c*. Then, the recording paper P is discharged onto a paper discharge tray 14 from a paper discharge port 13.

After the toner image is transferred onto the recording paper P, the surface of the photosensitive drum 1 is cleaned by a cleaning device 10 by removing residual transfer toner and paper dust therefrom to be used in subsequent image forming operations on another recording paper P again.

Figure 1:
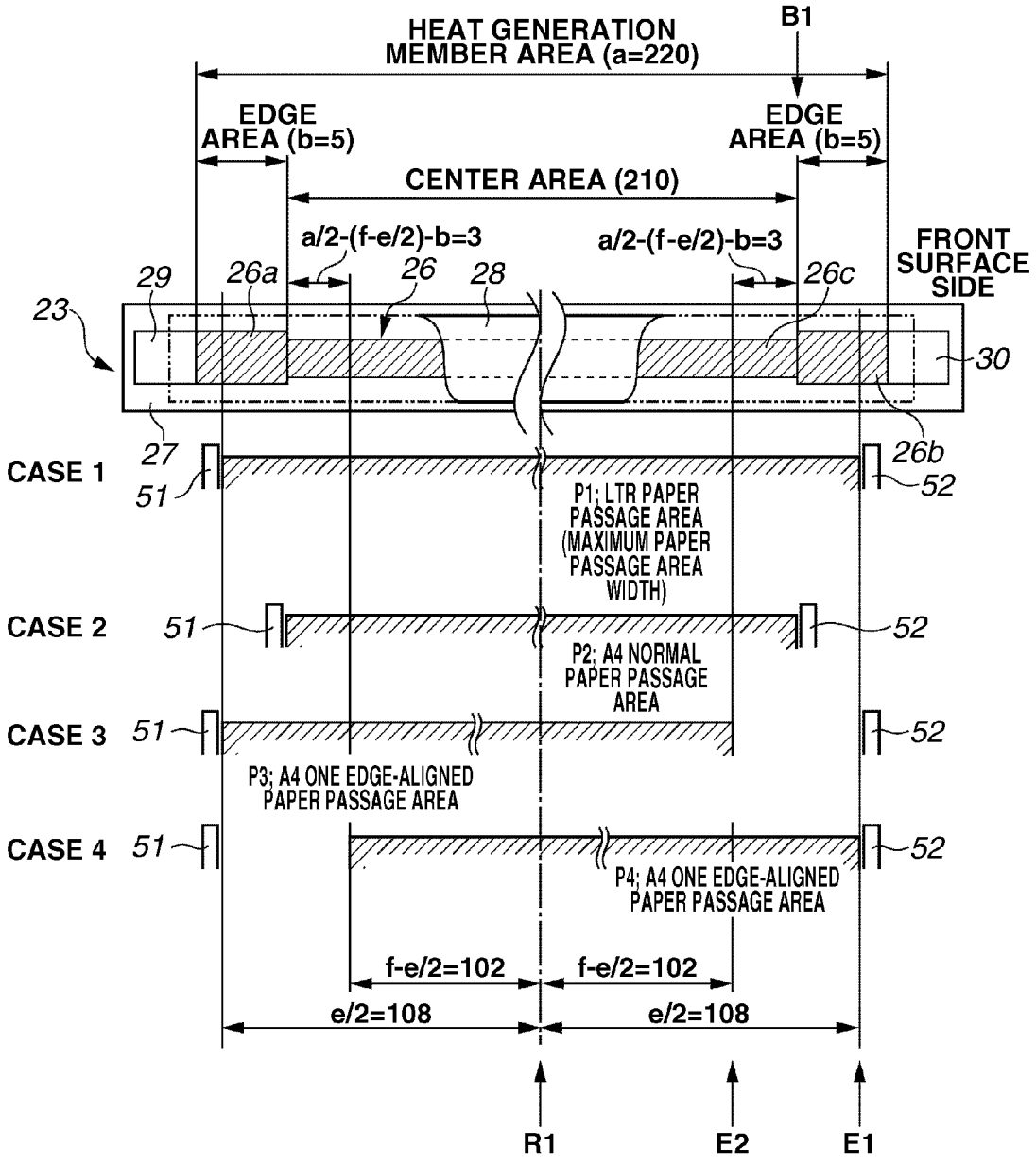
FIG. 1 is a front view of a heater according to a first exemplary embodiment of the present invention.

A paper feed cassette (paper feed unit) 5 includes recording paper position regulation members (recording paper position regulation members 51 and 52 illustrated in FIG. 1), which can move in a direction perpendicular to the recording paper conveyance direction. By moving the recording paper position regulation members according to the size of the recording paper P and thus regulating both side edges of the recording paper in parallel to the recording paper conveyance direction, the present exemplary embodiment can feed recording papers P of different sizes from the paper feed cassette 5 by a center-aligned conveyance reference (i.e., with a position R1 illustrated in FIG. 1 as the reference). In the present exemplary embodiment, the "center-aligned conveyance reference" refers to a method of conveying a recording paper P with the center of both side edges of the recording paper P in parallel to the conveyance direction thereof as the reference of conveyance.

Figure 3:
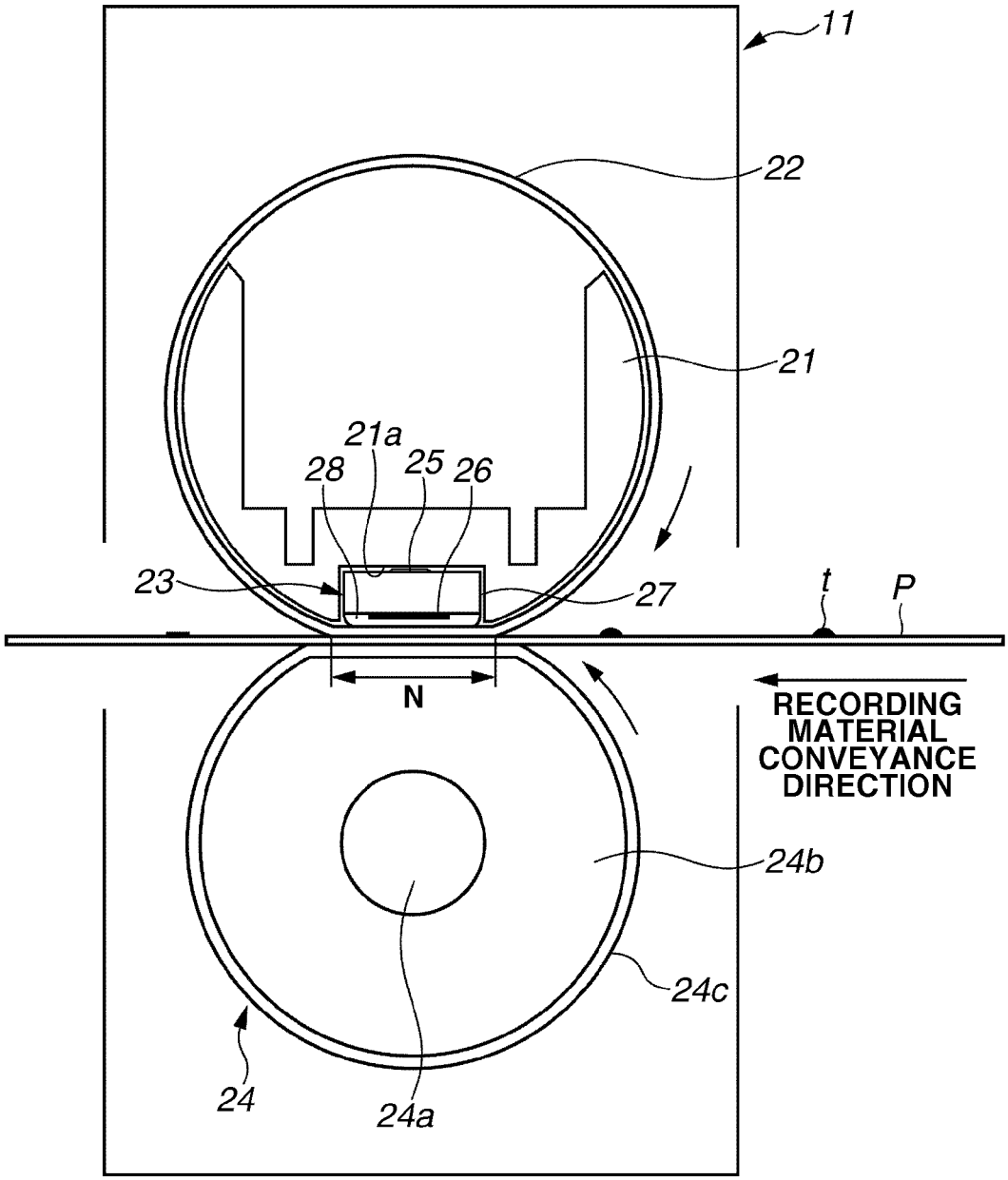
FIG. 3 is a cross section of a fixing unit according to an exemplary embodiment of the present invention.
Figure 5:
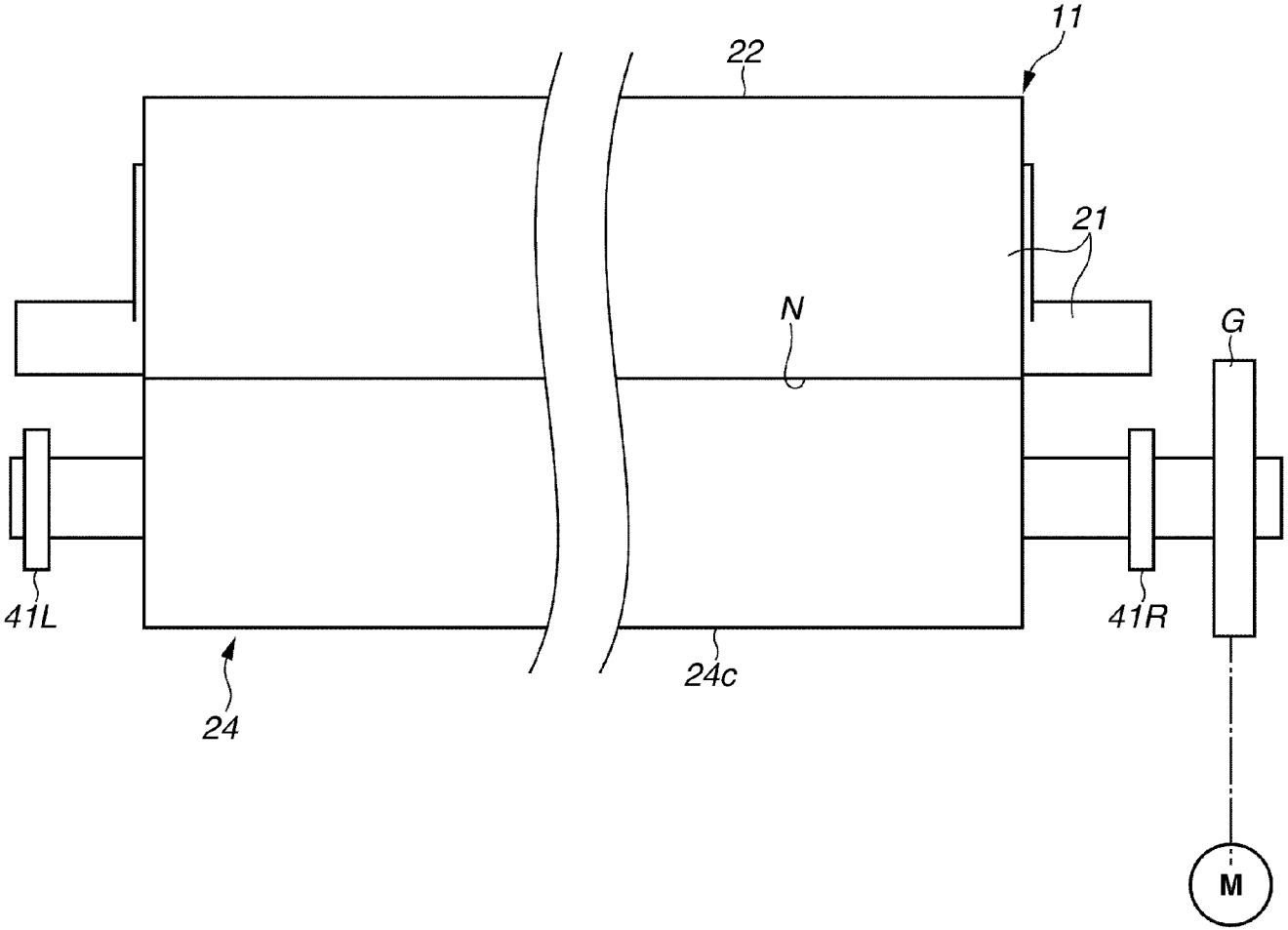
FIG. 5 illustrates the fixing unit as viewed from a direction of feeding a recording paper therein according to an exemplary embodiment of the present invention.

FIG. 3 is a cross section of an example of a fixing unit 11. FIG. 3 is a longitudinal section of the fixing unit 11. FIG. 5 illustrates the fixing unit 11 as viewed from a direction of feeding a recording paper therein.

In the following description, with respect to the fixing unit and members and components of the fixing unit, a "longitudinal direction" refers to a direction perpendicular to the recording paper conveyance direction in relation to the surface of the recording paper while a "lateral direction" refers to a direction in parallel to the recording paper conveyance direction in relation to the surface of the recording paper. Furthermore, the "length" refers to a dimension in the longitudinal direction while the "width" refers to a dimension in the lateral direction. In addition, with respect to a recording paper, the "direction of the width (or the "widthwide direction") refers to a direction perpendicular to the recording paper conveyance direction in relation to the surface of the recording paper. The widthwide direction of the recording paper is equivalent to the longitudinal direction of the fixing unit and the members and components thereof.

In the present exemplary embodiment, the fixing unit 11 includes a ceramic heater (heating member) 23, a fixing film (flexible member) 22, a stay (guiding member) 21, and a pressure roller (pressure member) 24. Each of the stay 21, the film 22, the heater 23, and the pressure roller 24 is a member having a shape longer in the longitudinal direction than in the lateral direction.

The stay 21 is shaped into a shape of a gutter in the longitudinal section by using a predetermined material having appropriate heat resistance and rigidity levels. The stay 21 supports the heater 23.

The film 22 is endlessly shaped (has a cylinder-like shape) and is made of a heatproof film. In addition, the film 22 is provided on the stay 21 to fit the outer surface shape of the stay 21.

The inner peripheral length of the film 22 is longer than the outer peripheral length of the stay 21 by about 3 mm. Accordingly, the film 22 can be provided on the stay 21 to fit the outer surface shape of the stay 21 with the sufficiently long peripheral length.

A lubricant (not illustrated) is applied in a space between the inner peripheral surface of the film 22 and the outer peripheral surface of the stay 21. Accordingly, the sliding resistance (friction) of the film 22, which rotates while being in contact with the outer peripheral surface of the stay 21, is reduced.

For the lubricant, perfluoropolyether grease (PFPE), which is thickened by fluoroethylene plastic such as polytetrafluoroethylene (PTFE), is used.

Now, each member will be described below.

In the film 22, the thickness of the film is set at a value equal to or less than 100 μm, more usefully at a value equal to or greater than 20 μm and equal to or less than 50 μm, so that the thermal capacity may be small and the image forming apparatus can be quickly activated.

As the material of the film 22, a single-layer film having a heat resistant characteristic, such as PTFE, perfluoro-alkoxyfluoro plastics (PFA), or perfluoro ethylene/propylene (FEP) plastic, can be used. Alternatively, as the material of the film 22, a composite-layer film including a film made of polyimide, polyamide-imide, polyetheretherketone (PEEK), polyether sulfone (PES), or phenylene sulfide (PPS), whose outer peripheral surface is coated with PTFE, PFA, or FEP, can be used.

In the present exemplary embodiment, a polyimide film having a thickness of about 50 μm, whose outer peripheral surface is coated with PTFE, is used as the film 22. The outer diameter of the film 22 is 18 mm.

The stay 21 can be made of a high heat-resistant resin made of polyimide, polyamide-imide, PEEK, PPS, or liquid crystal polymers or a composite material made of mixture of the above-described resin and a ceramic, metal, or glass material. In the present exemplary embodiment, a liquid crystal polymer is used as the material of the stay 21. The stay 21 is shaped in a shape of a gutter semicircular in cross section. The stay 21 is produced by injection-molding the liquid crystal polymer.

Both edges of the stay 21 in the longitudinal direction are supported by a side plate pair (not illustrated) of the fixing unit 11. A groove 21*a* having a concave shape is provided in a lower portion of the stay 21 facing the pressure roller 24 in the longitudinal direction. The heater 23 is supported by the groove 21*a*.

The pressure roller 24 includes a core 24*a*, an elastic member layer 24*b*, and a release layer 24*c*. The elastic member layer 24*b* is provided around the core 24*a*. The release layer 24*c*, which constitutes an outermost layer of the pressure roller 24, is provided around the elastic member layer 24*b*.

Figure 4:
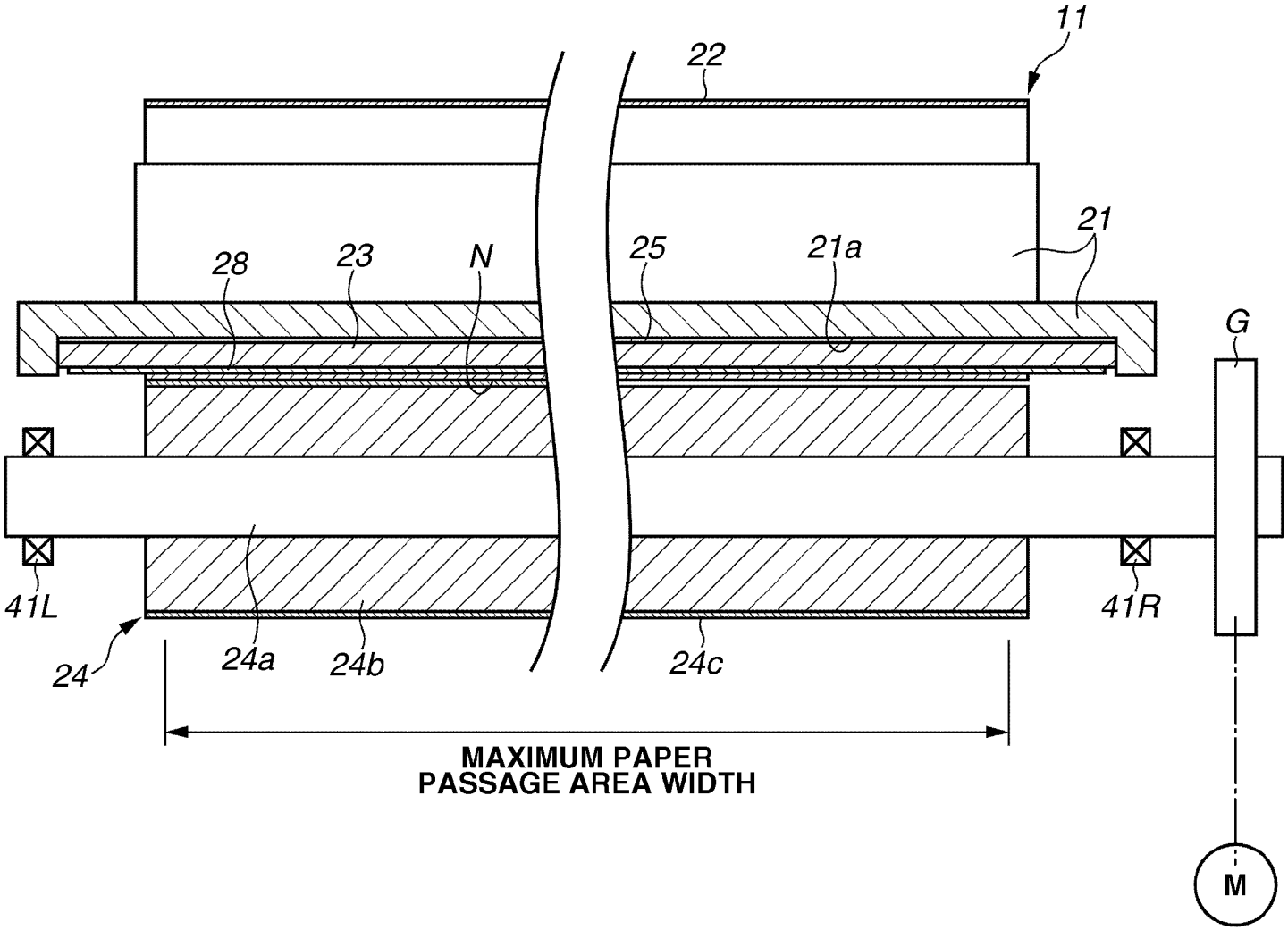
FIG. 4 is a longitudinal section of the fixing unit according to an exemplary embodiment of the present invention.

Both edges of the core 24*a* in the longitudinal direction are supported by the side plate pair of the fixing unit 11 on bearings 41L and 41R (FIG. 4). Thus, the pressure roller 24 is rotatably supported.

In the present exemplary embodiment, the core 24*a* is made of aluminum. The elastic member layer 24*b* is made of foam silicone rubber. The release layer 24*c* is made of a PFA tube having the thickness of about 30 μm. The outer diameter of the pressure roller 24 is 20 mm and the thickness of the elastic member layer 24*b* is 3 mm.

The pressure roller 24 is located in tandem with the film 22 below the film 22. Both edges of the core 24*a* are pressed against the stay 21 by a pressure member such as a pressure spring. Accordingly, the elastic member layer 24*b* of the pressure roller 24 is elastically deformed by the pressing force from the pressure spring. Thus, a nip portion N, which has a predetermined width and which is necessary for thermally fixing an unfixed toner image t on a recording paper, is formed between the outer peripheral surface (the surface) of the pressure roller 24 and the heater (heating member) 23 across the film 22.

Figure 2:
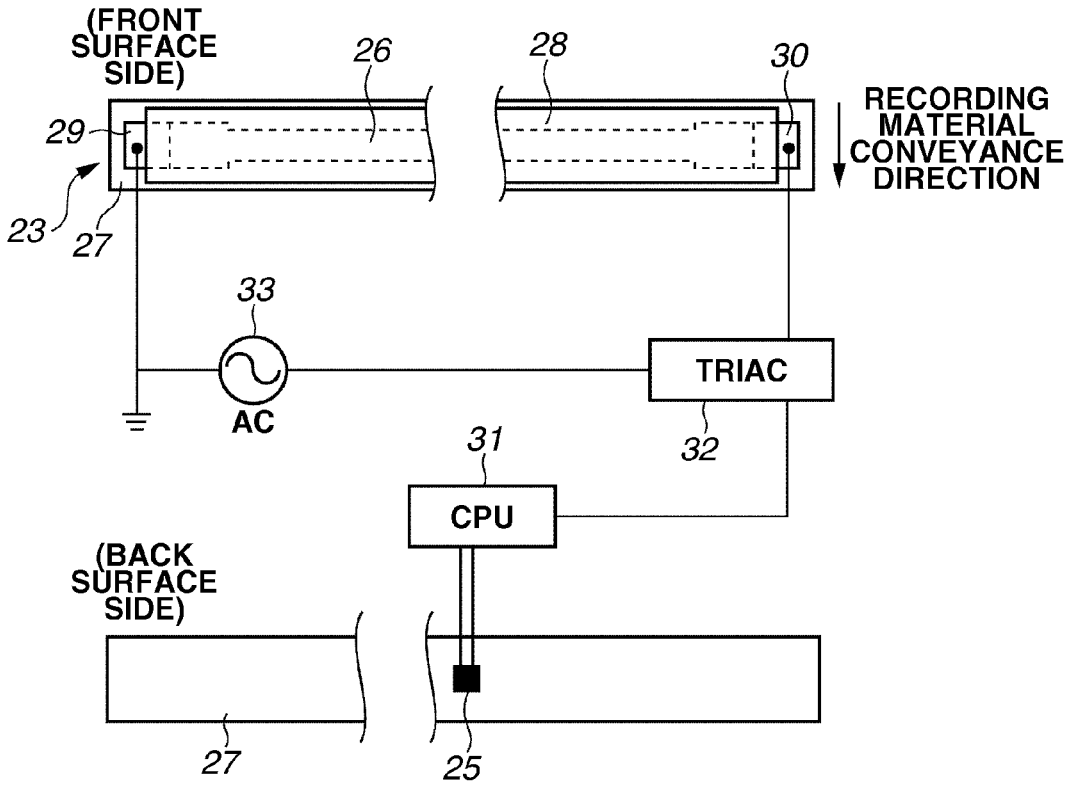
FIG. 2 illustrates an example of a temperature control circuit according to an exemplary embodiment of the present invention.

FIG. 1 is a front view of the heater 23 according to the present exemplary embodiment. FIG. 2 is a block diagram illustrating a temperature control system for the heater 23.

In the present exemplary embodiment, the heater 23 includes a substrate 27. The substrate 27 has a shape longer in the longitudinal direction than in the lateral direction and has heat resistant and insulation characteristics and a high thermal conductivity.

On the surface of the substrate 27 (facing the nip portion N), a heat generating resistor 26 is formed in the longitudinal direction of the substrate 27 (hereinafter simply referred to as a "substrate longitudinal direction"). In addition, on the surface of the substrate 27 facing the nip portion N, power supply electrodes 29 and 30 are formed integrally with the heat generating resistor 26 at both ends in the substrate longitudinal direction.

In addition, on the surface of the substrate 27, the heat resistant overcoating layer 28 is formed, which covers the heat generating resistor 26 and a part of each of the electrodes 29 and 30 to protect the heat generating resistor 26 and the electrodes 29 and 30. As described above, the heater 23 includes the heat generating resistor 26, which is formed on the substrate 27.

The substrate 27 can be made of a ceramics material, such as alumina or the aluminum nitride. In the present exemplary embodiment, an alumina substrate having a width of 7 mm, a length of 270 mm, and a thickness of 1 mm is used as the substrate 27.

The heat generating resistor 26 according to the present exemplary embodiment is made of a paste prepared by kneading inorganic binders, such as silver, palladium, and glass powder with an organic binder. The heat generating resistor 26 is formed on the surface of the substrate 27 in a band-like shape by screen printing.

For the material of the heat generating resistor 26, an electric resistance material, such as ruthenium dioxide ($RuO_2$) or tantalum nitride ($Ta_2N$), can be used instead of the above-described material. In the present exemplary embodiment, the resistance of the heat generating resistor 26 is 20Ω at room temperature (23° C.).

Now, the relationship between the heat generating resistor 26 and an LTR size paper or an A4 size paper will be described in detail below.

In the present exemplary embodiment, an "LTR size paper" refers to a paper whose size is set as the maximum printable recording paper width. More specifically, in the present exemplary embodiment, an "LTR size paper" refers to a first size recording paper, which is a recording paper having the largest width of the widths of standard size recording papers that can be used on the image forming apparatus according to the present exemplary embodiment. In addition, an "A4 size paper" refers to a second size recording paper, which is a recording paper having the second largest width of widths of standard size recording papers that can be used on the image forming apparatus. More specifically, on the image forming apparatus according to the present exemplary embodiment on which the paper is fed in the portrait orientation, a paper width e of an LTR size paper is 216 mm while a paper width f of an A4 size paper is 210 mm.

In the example illustrated in FIG. 1, in Case 1, an LTR size paper P1 is set aligned to the recording paper position regulation members 51 and 52, which regulate the position of the paper in the widthwide direction and which have been set to an LTR size position. In Case 2, an A4 size paper P2 is set aligned to the recording paper position regulation members 51 and 52 that have been set to an A4 size position.

In Case 3, in a state in which the recording paper position regulation members 51 and 52 are set to the LTR size position, an A4 size paper P3 is set aligned to the recording paper position regulation member 51 on a side edge thereof. In Case 4, in a state in which the recording paper position regulation members 51 and 52 are set to the LTR size position, an A4 size paper P4 is set aligned to the recording paper position regulation member 52 on a side edge thereof.

In other words, in Cases 3 and 4, the A4 size papers P3 and P4 are fed by one edge-aligned paper passage. More specifically, in one edge-aligned paper passage, one edge of a second size recording paper (a recording paper whose width is the greatest of widths of standard size recording papers except the width of a first size recording paper) is set aligned to the recording paper position regulation members when the recording paper position regulation members are set at a position for a largest paper that can be used on the image forming apparatus). In other words, in one edge-aligned paper passage, one edge of a second size recording paper is set aligned to the recording paper position regulation members when the recording paper position regulation members are set to a position for the first size recording paper.

An overall length a of the heat generating resistor 26 in the substrate longitudinal direction is 220 mm. More specifically, the length of the heat generating resistor in a direction perpendicular to the recording paper conveyance direction is longer (greater) than the width of a first size recording paper, which is the width (the LTR size paper width of 216 mm) the largest of the widths of standard size recording papers that can be used on the image forming apparatus.

The heat generating resistor 26 includes edge areas 26*a* and 26*b* and a center area 26*c*. The edge areas 26*a* and 26*b* exist on both edges of the heat generating resistor 26 in the substrate longitudinal direction. The center area 26*c* exists at a location on the heat generating resistor 26 between the edge areas 26*a* and 26*b*.

In the present exemplary embodiment, the width of the edge areas 26*a* and 26*b* in the substrate longitudinal direction is wider than the width of the center area 26*c*. In addition, an electrical resistance (resistance) d, which is an electrical resistance per unit length of the edge areas 26*a* and 26*b* in the substrate longitudinal direction, is smaller than an electrical resistance c, which is an electrical resistance per unit length of the center area 26*c* in the substrate longitudinal direction. Accordingly, the heat generating quantity in each of the edge areas 26*a* and 26*b* per unit length is smaller than that in the center area 26*c*.

In other words, in the present exemplary embodiment, the heat generating resistor 26 is designed so that the resistance of the heat generating resistor per unit length is smaller in the edge areas than in the center area. In addition, in the present exemplary embodiment, the ratio of the electrical resistance of the center area 26*c* per unit length to that of the edge areas 26*a* and 26*b* (d/c) becomes 0.55. In addition, the heat generating quantity per unit length of the edge areas 26*a* and 26*b* is 55% of that of the center area 26*c*.

In addition, the length of the center area 26*c* in the substrate longitudinal direction is 210 mm, while that of each of the edge areas 26*a* and 26*b* is 5 mm.

Suppose that the lengths are set in the above-described manner and that the recording paper position regulation members 51 and 52 are aligned to the maximum paper feeding width (the LTR size). If, as in Case 3 (FIG. 1), an A4 size paper is conveyed while being in contact with the recording paper position regulation member 51 in this state, then a position E2 of the edge of the A4 size paper that does not contact the regulation member lies at a position distant from the center R1 of the heat generating resistor 26 in the longitudinal direction by a length (f−e/2). The position E2 lies within the center area 26*c*.

In addition, in this case, a position E1 of both side edges of the recording paper P1 lies within the edge areas 26*a* and 26*b*, at a position distant from the center of the heat generating resistor 26 in the longitudinal direction by a length (e/2).

In other words, in Case 3, a boundary B1 between the center area 26*c* and the edge areas 26*a* and 26*b* is set at a position closer to the center of the heat generating resistor 26 than the side edge position E1 of the recording paper P1 and distant from the center of the heat generating resistor 26 than the side edge position E2 of the recording paper P3, which is closer to the recording paper position regulation member 52. The same applies to Case 4.

As described above, if one side edge of a second size recording paper, whose width is the greatest of the widths of standard size recording papers that can be used on the image forming apparatus except the width of the first size recording paper, is aligned to the recording paper position regulation member when the recording paper position regulation members are set at the position for the largest size paper, then the boundary position B1, at which the resistance per unit length varies, lies within an area between the other side edge of the second size recording paper and the side edge of the first size recording paper.

The electrodes 29 and 30 are made of a silver-palladium alloy by using a screen printing pattern. The heat resistant overcoating layer 28 is provided primarily to secure electrical insulation between the heat generating resistor 26 and the surface of the substrate 27 and to secure a sliding characteristic of the heat generating resistor 26 against the inner peripheral surface (the inner surface) of the film 22. In the present exemplary embodiment, a heat-resistant glass layer having a thickness of about 60 μm is used as the heat resistant overcoating layer 28.

A thermometry element (a temperature measurement device) 25 is provided on the back surface of the substrate 27 (the surface of the substrate 27 not facing the nip portion N) at a location substantially the center of the substrate 27 in the substrate longitudinal direction (within a small size paper feeding area).

In the present exemplary embodiment, an external contact type thermister, which is provided separately from the heater 23, is used as the thermometry element 25. The external contact type thermister 25 includes a heat insulating barrier provided on a supporting member (not illustrated) and a chip thermister element, which is fixedly provided on the heat insulating barrier. The thermometry element 25 contacts the back surface of the substrate 27 by a predetermined pressure force, with the chip thermister element being oriented downward (facing the back side of the heating member). In the present exemplary embodiment, a high heat resistant-liquid crystal polymer is used as the material of the supporting member while laminated ceramic papers are used as the heat insulating layer.

The substrate 27 of the heater 23 is fixedly supported by the groove 21*a* of the stay 21 while being exposed to the outside of the groove 21*a* and with the portion of the heater 23 including the substrate 27 facing downwards.

A drive gear G (FIG. 4), which is provided on the edge of the core 24*a* of the pressure roller 24, is rotated to be driven by a fixing motor M. Thus, the pressure roller 24 rotates in a direction indicated with an arrow illustrated in FIG. 3. The rotation of the pressure roller 24 transfers a rotational force to the film 22 by a frictional force generated between the surface of the pressure roller 24 and the surface of the film 22 in the nip portion N.

With the rotational force, an inner surface of the film 22 slides while being in close contact with the heat resistant overcoating layer 28, which is provided on the surface of the substrate 27 of the heater 23, in the nip portion N. While sliding on the heat resistant overcoating layer 28, the film 22 is driven and rotated along an outer periphery of the stay 21 in a direction indicated with another arrow illustrated in FIG. 3, at a peripheral speed substantially the same as the rotational peripheral speed of the pressure roller 24.

A central processing unit (CPU) (control unit) 31 (FIG. 2) switches on a triac (power control unit) 32. When the triac 32 is switched on, power is supplied from an alternate current (AC) power source 33 to the electrodes 29 and 30 of the heater 23. When power is supplied to the heat generating resistor 26 via the electrodes 29 and 30, the heat generating resistor 26 generates heat in the entire longitudinal length and raises the temperature of the heater 23.

When it is detected by the thermister 25 that the temperature of the heater 23 has been raised, an analog-to-digital (A/D) converter (not illustrated) A/D-converts an output of the thermister 25. The CPU 31 receives the A/D-converted output of the thermister 25.

The CPU 31 controls power to be supplied to the heat generating resistor 26 via the triac 32 by phase control or frequency control based on the received information (temperature information) to control the temperature of the heater 23.

More specifically, if the temperature of the heater 23 detected by the thermister 25 is lower than a predetermined setting temperature (a target temperature), then the CPU 31 executes control of the triac 32 for raising the temperature of the heater 23. On the other hand, if the temperature of the heater 23 detected by the thermister 25 is higher than the predetermined setting temperature, then the CPU 31 executes control of the triac 32 for lowering the temperature of the heater 23. Thus, the CPU 31 maintains the temperature of the heater 23 at the setting temperature. In the present exemplary embodiment, by executing phase control, the output of the thermister 25 can vary from 0% to 100% in twenty-one incremental stages of 5%. If the power is fully supplied to the heater 23, the level of the output is 100%.

When the temperature of the heater 23 is raised to the setting temperature and when the rotation peripheral speed of the film 22, which is rotated according to the rotation of the pressure roller 24, becomes constant, the recording paper P having an unfixed toner image t thereon is conveyed into the nip portion N. Then, the recording paper P conveyed from the nip portion N while being pinched between the surfaces of the film 22 and the pressure roller 24 in the nip portion N.

While the recording paper P is conveyed through the nip portion N, heat from the heater 23 is applied to the unfixed toner image t via the film 22. In addition, at this timing, pressure (nip pressure) is applied to the unfixed toner image t. Thus, the unfixed toner image t is thermally fixed onto the recording paper P. After passing through the nip portion N, the recording paper P is separated from the surface of the film 22 and then is conveyed to be discharged out of the fixing unit 11.

Figure 13:
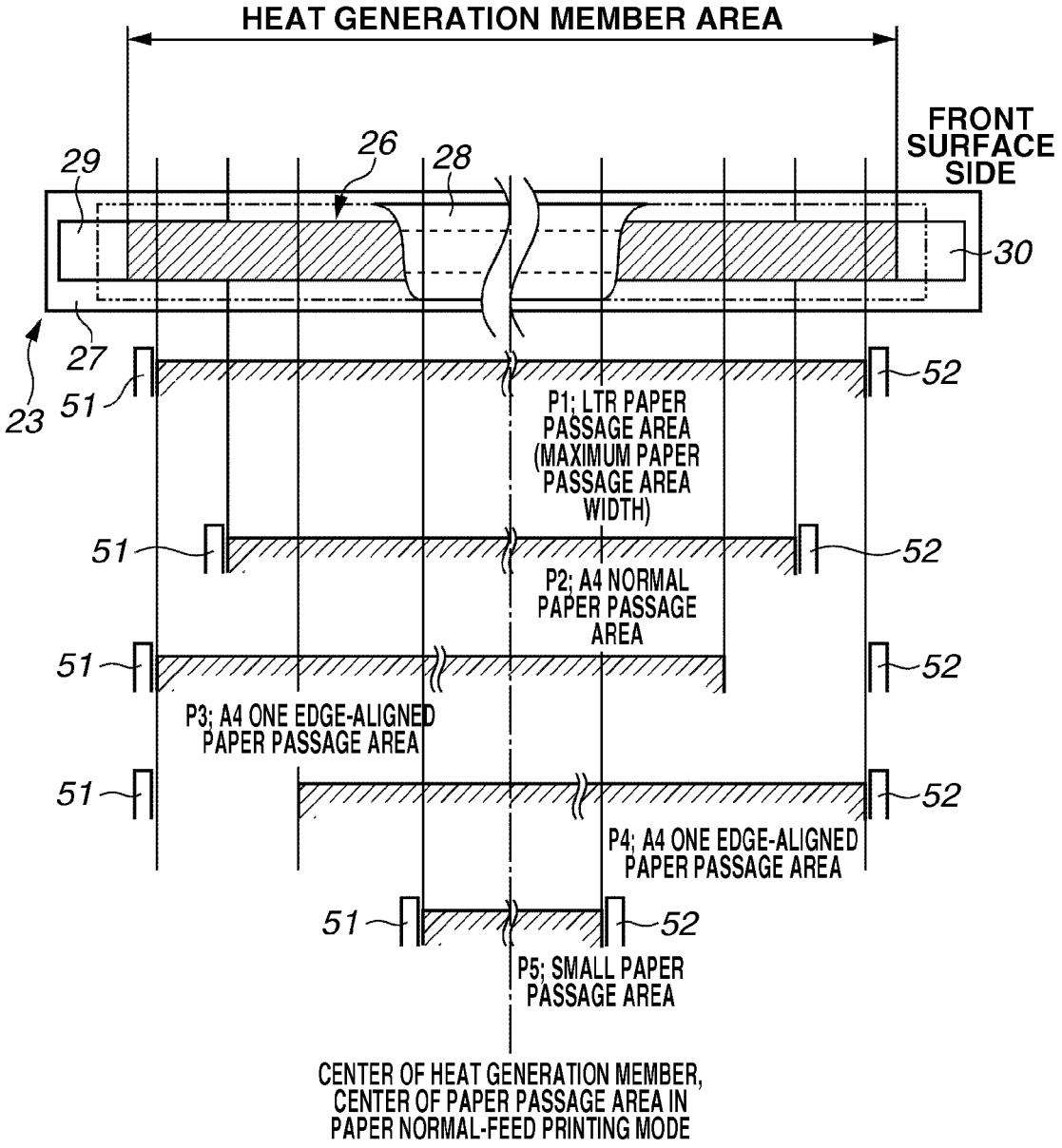
FIG. 13 illustrates a positional relationship between a conventional heater and a paper in the longitudinal direction.

As an experiment, the fixing property of and the temperature rise in non-paper passage areas that may occur on the heater 23 according to the present exemplary embodiment and the conventional heater illustrated in FIG. 13 were verified and observed. The fixing property of and the temperature rise in non-paper passage areas that may occur on the heater 23 according to the present exemplary embodiment are as described above.

With respect to the conventional heater illustrated in FIG. 13, the width in a substrate latitudinal direction is constant in the entire longitudinal direction. Furthermore, the electrical resistance per unit length thereof is constant. The overall lengths of a heat generating resistor of the conventional heater have four different lengths of 214 mm, 215 mm, 216 mm, and 217 mm. The other configuration of the conventional heater illustrated in FIG. 13 is similar to that of the present exemplary embodiment.

For the fixing property, the fixing property (LTR fixing property) of an unfixed toner image when an LTR size recording paper, whose width is the greatest of the widths of standard size papers that can be used on the image forming apparatus, is fed into the nip portion N was observed. In the experiment, the LTR fixing property was evaluated in three levels. More specifically, if a toner image on the recording paper P after being thermally fixed thereon was completely lost when rubbed, the LTR fixing property was evaluated "bad" ("x") while if only a part of the toner image was lost when rubbed, the LTR fixing property was evaluated "not bad" ("▲") and if the toner image was not lost at all even when rubbed, the LTR fixing property was evaluated "good" ("○").

For the temperature rise in non-paper passage areas, it was evaluated whether the temperature of the non-paper-passage area rose to an excessively high temperature ("non-paper-passage area temperature rise characteristic") when an A4 size paper aligned by one edge-aligned paper passage was fed into the nip portion N.

With respect to the non-paper-passage area temperature rise characteristic, the temperature of the pressure roller, which may be damaged first when the non-paper-passage area temperature rise occurs. The non-paper-passage area temperature rise characteristic was evaluated in three levels. More specifically, if the temperature of the pressure roller was equal to or higher than the heat resistant temperature (260° C.) of PFA, which is the material of the outermost layer of the pressure roller, then the non-paper-passage area temperature rise characteristic was evaluated "bad" ("x"). On the other hand, if the temperature of the pressure roller fell within a range higher than 230° C. and lower than 260° C., then the non-paper-passage area temperature rise characteristic was evaluated "not bad" ("▲"), while if the temperature of the pressure roller was equal to or lower than 230° C., then the non-paper-passage area temperature rise characteristic was evaluated "good" ("○").

As described above, in the present exemplary embodiment, the "one edge-aligned paper passage" refers to a paper feeding mode in which the recording paper position regulation members are set to the position for feeding an LTR size paper, the side edge of an A4 size paper comes into contact with either one of the recording paper position regulation members, and the A4 size paper is fed into the nip portion N. When an A4 size paper is fed in the one edge-aligned paper passage mode, the temperature of the pressure roller in non-paper-passage areas becomes the highest of all the temperatures of the non-paper-passage areas in all the cases in the present example.

In this evaluation, the same conveyance speed and paper-to-paper distance were used for the LTR size paper and the A4 size paper.

Table 1 shows results of the evaluation of the fixing properties and the non-paper-passage area temperature rise characteristics according to the present exemplary embodiment and comparative examples 1 through 4. As can be known from the results of the comparative examples 1 through 4 in Table 1, if the overall length of the heat generating resistor is equal to or smaller than 215 mm, a sufficient LTR fixing property is not achieved. On the other hand, if the heat generating resistor overall length is equal to or greater than 216 mm, the non-paper-passage area temperature rise cannot be effectively suppressed.

More specifically, in the conventional heater, whose electrical resistance of the heat generating resistor per unit length is constant in the entire longitudinal direction, a sufficiently high LTR fixing property cannot be achieved at the same time as effectively suppressing the non-paper-passage area temperature rise. On the other hand, as can be known from Table 1, it is found that the present exemplary embodiment can achieve a sufficiently high fixing property at the same time as effectively suppressing the non-paper-passage area temperature rise.

It can be considered that the above-described effect of the present exemplary embodiment can be achieved because in the present exemplary embodiment, which uses parameters such as the electrical resistance of the edge areas per unit length and the length of the edge area, the heat generating quantity of the heater on the edge thereof can be adjusted.

TABLE 1

| Comparative Example (Or Exemplary Embodiment) | Overall Length of Heating Member (a) | Specifications of Heater: Length of Edge Area (b) | d/c | Whether Non-Paper-Passage Area Temp. Rise Occurs in A4 Paper One Edge-Aligned Paper Passage Mode | LTR Fixing Property |
|---|---|---|---|---|---|
| 1 | 214 | — | — | ○ | x |
| 2 | 215 | — | — | ○ | x |
| 3 | 216 | — | — | x | ○ |
| 4 | 217 | — | — | x | ○ |
| (First Exemplary Embodiment) | 220 | 5 | 0.55 | ○ | ○ |

* In Table 1, "d" refers to the resistance per unit length of the edge area, "c" refers to the resistance per unit length of the center area.

In addition, the fixing property and the non-paper-passage area temperature rise of the heater according to the present exemplary embodiment, whose resistance per unit length of the edge area is lower than that of the center area, were evaluated by using the following three parameters:

(1) the overall length of the heat generating resistor (a)

(2) the ratio of the electrical resistance per unit length of the edge area to that of the center area (d/c)

(3) the length of the edge area (b).

In addition, in the evaluation, the presence of a useful relationship between the fixing property and the non-paper-passage area temperature rise characteristic for achieving a good levels of the same were checked according to a result of a value equivalent to the heat generating quantity of the non-paper-passage area when an A4 size paper was fed, which was derived from values of the above-described parameters.

The value equivalent to the non-paper-passage area heat generating quantity can be expressed by the following expression:

$$\text{Value equivalent to non-paper-passage area heat generating quantity}=b\times(d/c)+\{a/2-(f-e/2)-b\}\times(c/c)$$

where "a" (mm) denotes the overall length of the heat generating resistor in the longitudinal direction, "b" (mm) denotes the length of the edge area of the heat generating resistor, "c" denotes the electrical resistance per unit length (Ω/mm) of the center area, "d" denotes the electrical resistance per unit length (Ω/mm) of the edge area, "e" denotes the width of the LTR size paper (216 mm), and "f" denotes the width of the A4 size paper (210 mm).

Because the heat generating quantity is substantially proportional to the electrical resistance, in order to relatively observe the heat generating quantity of the non-paper-passage area, it is enough to observe the electrical resistance of the non-paper-passage area. For easier understanding, in the present exemplary embodiment, the electrical resistance per unit length of the center area 26*c* (c) is divided by the electrical resistance per unit length of the center area 26*c* (c) so that the resulting electrical resistance per unit length of the center area 26*c* becomes "1".

In other words, the term "b×(d/c)" of the above-described expression expresses a value equivalent to the heat generating quantity of the edge area 26*a* or 26*b* of the non-paper-passage area. The term "{a/2−(f−e/2)−b}×(c/c)" of the above-described expression expresses a value equivalent to the heat generating quantity of the center area 26*c* of the non-paper-passage area. Accordingly, the above-described expression, in which the terms are added to each other, expresses a value equivalent to the heat generating quantity of the entire non-paper-passage area.

In the present exemplary embodiment, "a" has the value 220 mm, "b" has the value 5 mm, "d/c" has the value 0.55, "e" has the value 216 mm, and "f" has the value 210 mm. Accordingly, the value equivalent to the heat generating quantity of the non-paper-passage area can be calculated as follows:

$$5\times0.55+\{220/2-(210-216/2)-5\}\times1=5.75.$$

If a plurality of heat generating resistors having different shapes is provided in the paper conveyance direction, the present exemplary embodiment executes the same calculation for each of the plurality of heat generating resistors. In this case, an average value of the resulting values of the calculations is used as the value equivalent to the heat generating quantity of the non-paper-passage area.

In the above-described evaluation experiment, the following points were considered in setting the parameter values.

More specifically, the overall length of the heat generating resistor of 216 mm (=the width of an LTR size paper) or greater is necessary in achieving a sufficient fixing property based on the results described in Table 1. In addition, it is necessary to set the boundary B1 between the edge area and the center area at a location closer to the center of the heater 23 than the location of the edge of the width of the LTR size paper (216 mm) in order to effectively suppressing or alleviating the non-paper-passage area temperature rise based on the results described in Table 1.

In addition, in an area closer to the center of the heater 23 than the location of the edge of the paper passage area when an A4 size paper is fed by one edge-aligned paper feeding method (204 mm), the heat of the heater 23 is absorbed by the paper fed thereon. Accordingly, it is not necessary to decrease the heat generating quantity of the heater 23 in this area. Therefore, it is necessary to provide the edge area in an area outside the position at which the distance is 204 mm.

Table 2 describes specifications of the heater used in the experiment and results of the experiment. The settings of the evaluation of the fixing property and the non-paper-passage area temperature rise characteristic similar to those of the above-described experiment were used in this experiment.

By referring to Table 2, it is known that if the value equivalent to the heat generating quantity of the non-paper-passage area is great, the non-paper-passage area temperature rise cannot be effectively suppressed or alleviated while if the value equivalent to the heat generating quantity of the non-paper-passage area is small, a sufficiently high fixing property cannot be efficiently achieved.

Furthermore, it is known from Table 2 that it is further useful if the value equivalent to the heat generating quantity of the non-paper-passage area lies within a range of values from 5.4 to 6.4. More specifically, it can be known that it is further useful if the following is satisfied:

$$5.4 \leq b \times (d/c) + \{a/2 - (f - e/2) - b\} \leq 6.4.$$

TABLE 2

| Overall Length of Heating Member (a) | Specifications of Heater: Length of Edge Area (b) | d/c | Value Equivalent to Calorific Value of Non-paper-Passage Area | Whether Non-Paper-Passage Area Temp. Rise Occurs in A4 Paper One Edge-Aligned Paper Passage Mode | LTR Fixing Property |
|---|---|---|---|---|---|
| 218 | 6 | 0.95 | 6.7 | ○ | x |
| 218 | 6 | 0.9 | 6.4 | ○ | ○ |
| 218 | 6 | 0.7 | 5.2 | ○ | ○ |
| 218 | 6 | 0.6 | 4.6 | x | ○ |
| 218 | 4 | 0.95 | 6.8 | ○ | x |
| 218 | 4 | 0.85 | 6.4 | ○ | ○ |
| 218 | 4 | 0.6 | 5.4 | ○ | ○ |
| 218 | 4 | 0.5 | 5 | x | ○ |
| 220 | 7 | 0.9 | 7.3 | ○ | x |
| 220 | 7 | 0.8 | 6.6 | ○ | ○ |
| 220 | 7 | 0.6 | 5.2 | ○ | ○ |
| 220 | 7 | 0.45 | 4.15 | x | ○ |
| 220 | 5 | 0.75 | 6.75 | ○ | x |
| 220 | 5 | 0.7 | 6.5 | ○ | ○ |
| 220 | 5 | 0.55 | 5.75 | ○ | ○ |
| 220 | 5 | 0.45 | 5.25 | ○ | ○ |
| 220 | 5 | 0.3 | 4.5 | x | ○ |
| 222 | 8 | 0.8 | 7.4 | ○ | x |
| 222 | 8 | 0.7 | 6.6 | ○ | ○ |
| 222 | 8 | 0.55 | 5.4 | ○ | ○ |
| 222 | 8 | 0.5 | 5 | x | ○ |
| 222 | 6 | 0.7 | 7.2 | ○ | x |
| 222 | 6 | 0.6 | 6.6 | ○ | ○ |
| 222 | 6 | 0.4 | 5.4 | ○ | ○ |
| 222 | 6 | 0.3 | 4.8 | x | ○ |

* In Table 2, "d" refers to the resistance per unit length of the edge area, "c" refers to the resistance per unit length of the center area.

As described above, in the heater 23 according to the present exemplary embodiment, the overall length of the heat generating resistor 26 is set longer than the width of the LTR size paper (216 mm), which is the maximum printable paper width. In addition, the electrical resistance per unit length of the edge areas 26*a* and 26*b* of the heat generating resistor 26 is set smaller than that of the center area 26*c*.

In addition, in the present exemplary embodiment, the position of the boundary B1 between the center area 26*c* and the edge areas 26*a* and 26*b* is set so that the position of the side edge of the LTR size paper exists within the edge areas 26*a* and 26*b* whose electrical resistance per unit length is low. In addition, in the present exemplary embodiment, the position of the boundary B1 between the center area 26*c* and the edge areas 26*a* and 26*b* is set, if an A4 size paper, which is a standard size paper having a width that is the greatest of the widths of standard size papers that can be used on the image forming apparatus except the width of the LTR size paper, is fed by the one edge-aligned paper feeding method, in which the A4 size paper is aligned on one side thereof, so that the position E2 of the other edge of the A4 size paper exists within the center area 26*c*, whose electrical resistance per unit length is high.

With the above-described configuration, the present exemplary embodiment can appropriately fix the unfixed toner image t on an LTR size paper by using the heat generating resistor 26, whose overall length is longer than the width of the LTR size paper. In addition, if an A4 size paper is fed by the one edge-aligned paper feeding method, the present exemplary embodiment can effectively suppress or alleviate the temperature rise in non-paper passage areas including the edge areas 26*a* and 26*b*.

Therefore, in serially fixing a plurality of recording papers, the fixing unit 11 according to the present exemplary embodiment that uses the heater 23 can effectively suppress or alleviate the excessive rise in the temperature of the heater 23 when the A4 size paper is printed at the conveyance speed and the paper-to-paper distance similar to those in printing an LTR size paper. In addition, with the above-described configuration, the present exemplary embodiment can achieve a useful fixing property for fixing an unfixed toner image t when an LTR size paper is used.

In the present exemplary embodiment, the width of an LTR size paper is set as the maximum printable paper width. Furthermore, in the present exemplary embodiment, it is supposed that an A4 size paper, whose width is smaller than that of the LTR size paper, is fed by the one edge-aligned paper feeding method. However, the present invention is not limited to this.

More specifically, the present exemplary embodiment can be implemented if the size of an A3 size paper (297×420 mm) is set as the maximum printable paper width and if an ledger size paper (11×17 inches (≈279×432 mm)) is fed by the one edge-aligned paper feeding method.

More specifically, the present exemplary embodiment can be applied to a printer in which the size of an A3 size paper is set as the first size and the size of a ledger size paper is set as the second size (the size of a paper whose width is the greatest of the widths of the standard size papers that can be used on the printer except the width of the first size paper).

Figure 6:
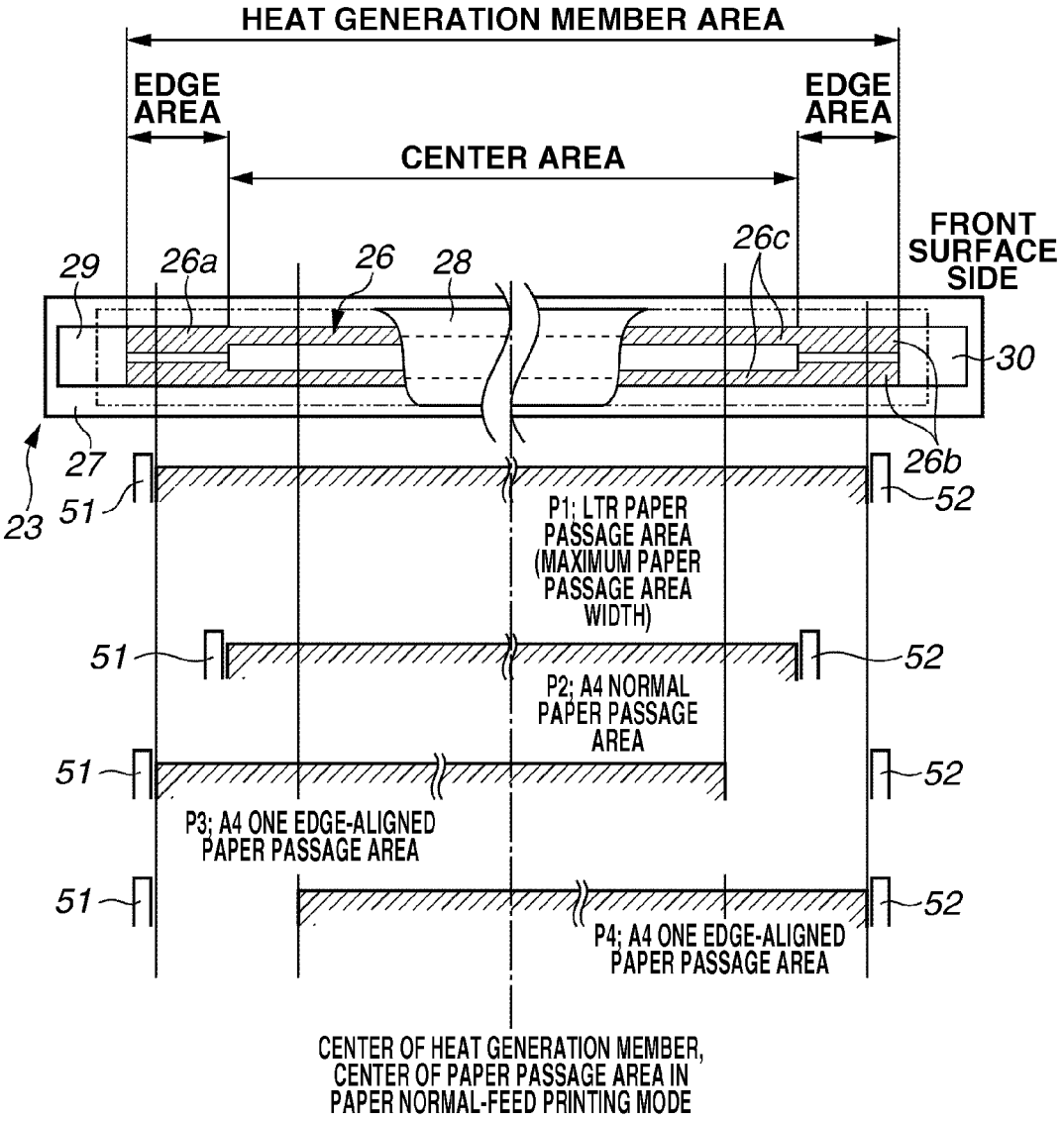
FIG. 6 is a front view of a heater according to a second exemplary embodiment of the present invention.

FIG. 6 is a front view of a heater according to a second exemplary embodiment of the present invention. In the present exemplary embodiment, members, parts, and components similar to those of the heater 23 described above in the first exemplary embodiment and the heater 23 itself are provided with the same reference numerals and symbols. Accordingly, the description thereof will not be repeated here. The same applies to each of third through fifth exemplary embodiments of the present invention.

In the first exemplary embodiment, the heater 23 includes the heat generating resistor 26 provided on the surface of the substrate 27, which is produced by forming one band-like shaped pattern in the substrate longitudinal direction. However, the number of the heat generating resistors 26 is not limited to one. In other words, a plurality of heat generating resistors 26 can be provided.

The heater 23 according to the present exemplary embodiment has the configuration similar to that of the heater 23 according to the first exemplary embodiment except that the heater 23 according to the present exemplary embodiment includes a heat generating resistor 26, which is produced by forming two band-like shaped patterns on the surface of a substrate 27 in the substrate longitudinal direction.

Each of the two heat generating resistors 26 according to the present exemplary embodiment includes edge areas 26*a* and 26*b* provided on side edges of the heat generating resistor 26 in the substrate longitudinal direction. In addition, each of the two heat generating resistors 26 includes a center area 26*c*, which is provided between the edge areas 26*a* and 26*b*.

In addition, each of the two heat generating resistors 26 has the above-described configuration so that the heat generating quantity per unit length of the edge areas 26*a* and 26*b* becomes smaller than that of the center area 26*c*. Furthermore, each of the two heat generating resistors 26 has the above-described configuration so that the electrical resistance per unit length of the edge areas 26*a* and 26*b* becomes smaller than that of the center area 26*c*.

In the present exemplary embodiment, areas existing in the location closer to the center of the heater 23 than the location of an area extending from the edge of the heat generating resistor 26 in the longitudinal direction to the side edge of the LTR size paper, whose width is the greatest of the widths of standard size papers that can be used on the image forming apparatus (i.e., an area of a width in a range of 2 to 5 mm), is used as the edge areas 26*a* and 26*b* of the heat generating resistor 26.

In addition, in the edge areas 26*a* and 26*b*, the width of the heat generating resistor 26 in the substrate lateral direction is wider than the width of the center area 26*c* in the substrate lateral direction inwards (towards the area closer to the center of the heater 23) in the substrate lateral direction so that the heat generating quantity per unit length of the edge areas 26*a* and 26*b* becomes smaller than that of the center area 26*c* by 45% thereof.

With the above-described configuration, the heater 23 according to the present exemplary embodiment can implement the effect similar to that implemented by the heater 23 according to the first exemplary embodiment.

Figure 7:
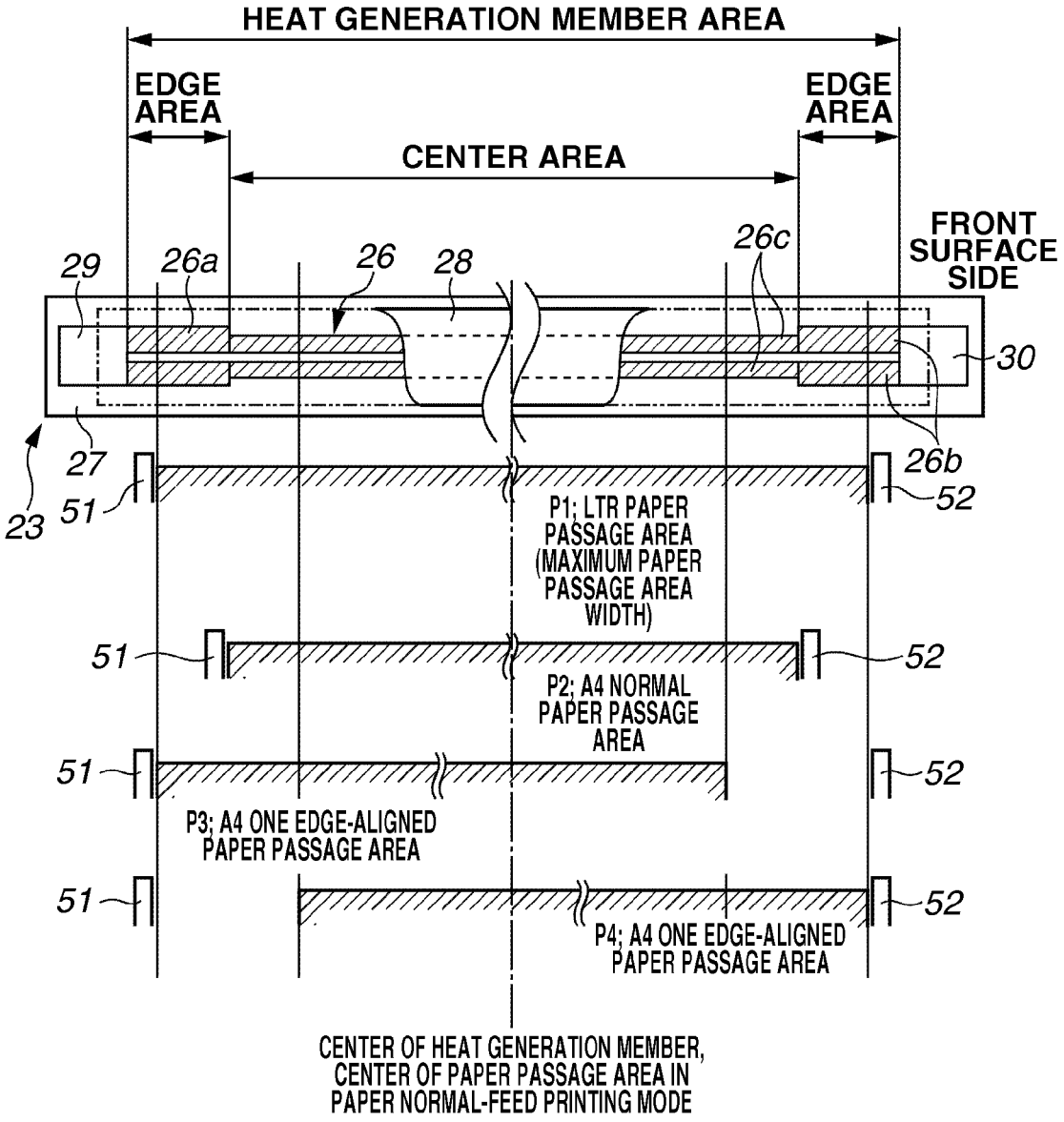
FIG. 7 is a front view of a heater according to a third exemplary embodiment of the present invention.

FIG. 7 is a front view of a heater according to the third exemplary embodiment of the present invention. In the present exemplary embodiment, a heater 23 includes heat generating resistors 26 of two band-like shaped patterns formed on the surface of a substrate 27 in the substrate longitudinal direction.

The heater 23 according to the present exemplary embodiment has a configuration similar to that of the heater 23 according to the second exemplary embodiment except for the following point. More specifically, in the present exemplary embodiment, the width of edge areas 26*a* and 26*b* of the two heat generating resistors 26 in the substrate lateral direction is wider than that of a center area 26*c* in the substrate lateral direction outwards (towards the area more distant from the center of the heater 23) in the substrate lateral direction.

With the above-described configuration, the heater 23 according to the present exemplary embodiment can implement the effect similar to that implemented by the heater 23 according to the first exemplary embodiment.

Figure 8:
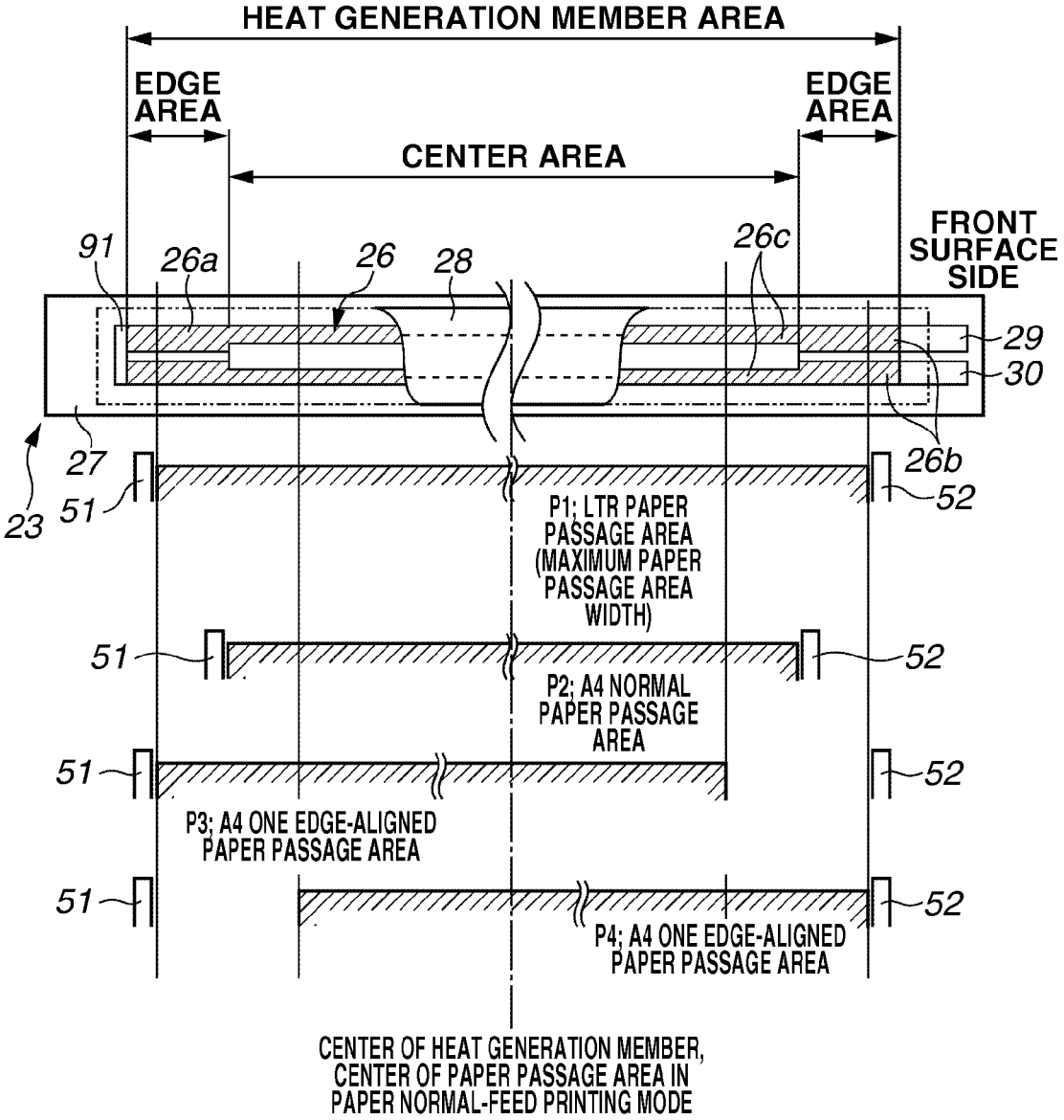
FIG. 8 is a front view of a heater according to a fourth exemplary embodiment of the present invention.

FIG. 8 is a front view of a heater according to the fourth exemplary embodiment of the present invention. In the present exemplary embodiment, a heater 23 includes heat generating resistors 26 of two band-like shaped patterns formed on the surface of a substrate 27 in the substrate longitudinal direction.

Furthermore, in the present exemplary embodiment, power supply electrodes 29 and 30 are provided one after another on one edge of the two heat generating resistors 26 in the substrate longitudinal direction. In addition, the other edges of the two heat generating resistors 26 are electrically connected by a conductive portion 91. The heater 23 according to the present exemplary embodiment has a configuration similar to that of the heater 23 according to the second exemplary embodiment except for the above-described points.

With the above-described configuration, the heater 23 according to the present exemplary embodiment can implement the effect similar to that implemented by the heater 23 according to the first exemplary embodiment.

Figure 9:
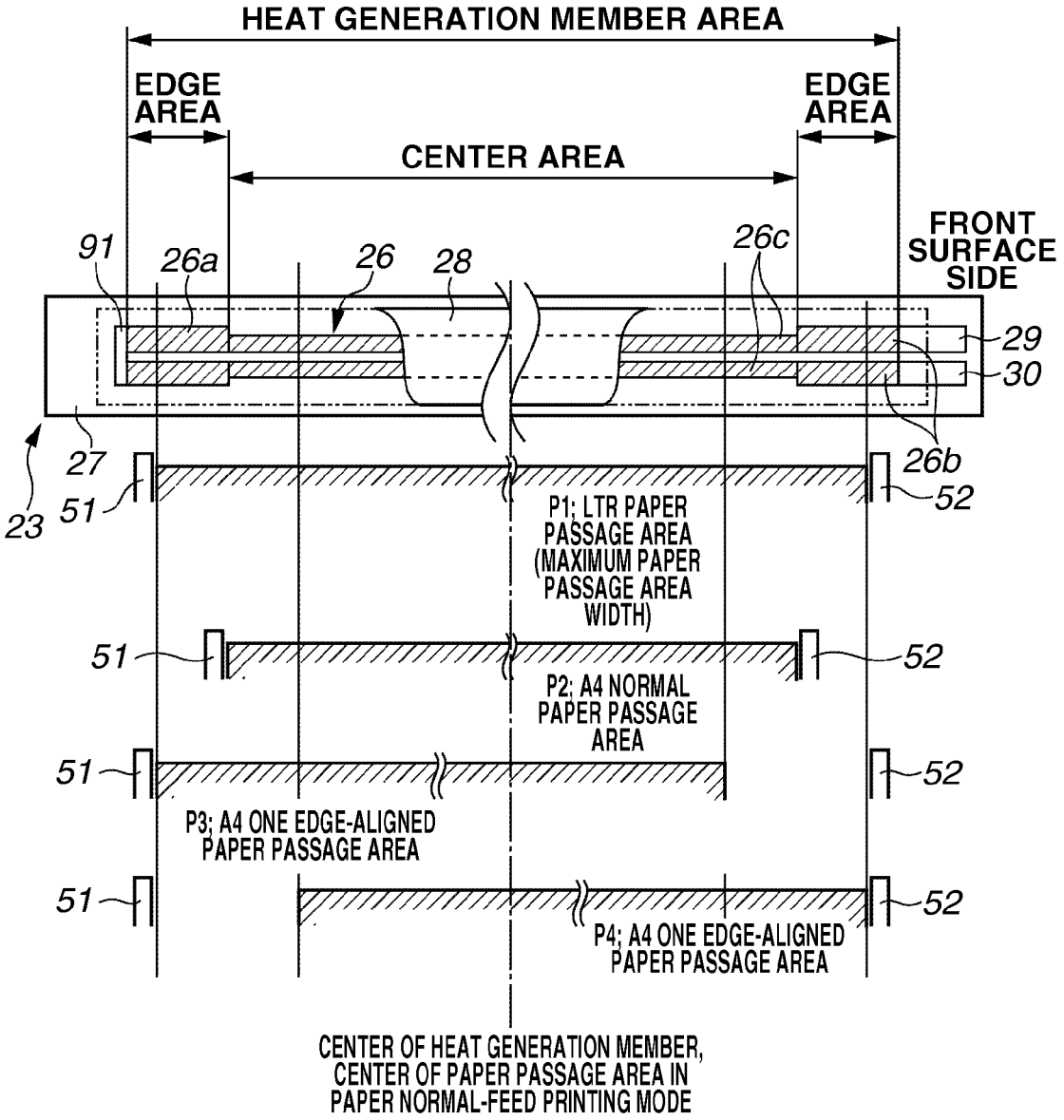
FIG. 9 is a front view of a heater according to a fifth exemplary embodiment of the present invention.

FIG. 9 is a front view of a heater according to the fifth exemplary embodiment of the present invention. In the present exemplary embodiment, a heater 23 includes heat generating resistors 26 of two band-like shaped patterns formed on the surface of a substrate 27 in the substrate longitudinal direction.

Furthermore, in the present exemplary embodiment, power supply electrodes 29 and 30 are provided one after another on one edge of the two heat generating resistors 26 in the substrate longitudinal direction. In addition, the other edges of the two heat generating resistors 26 are electrically connected by a conductive portion 91. The heater 23 according to the present exemplary embodiment has a configuration similar to that of the heater 23 according to the third exemplary embodiment except for the above-described points.

With the above-described configuration, the heater 23 according to the present exemplary embodiment can implement the effect similar to that implemented by the heater 23 according to the first exemplary embodiment.

In the first through fifth exemplary embodiments described above, the electrical resistance is adjusted according to the width of the heat generating resistor 26 in the substrate lateral direction. However, the present invention is not limited to this. In other words, any different other methods for changing the electrical resistance per unit length of the heat generating resistor 26 can be used.

More specifically, it is also useful if the same width of the heat generating resistor 26 in the substrate lateral direction is set for the center area and the edge area and if the electrical resistance value (the heat generating quantity) of the center area and the edge area is adjusted by changing the thickness of the edge area and the center area. In addition, it is also useful if the heat generating quantity of the edge area is set at a value smaller than that of the center area by using the center area having the thickness thicker than that of the edge area.

In each of the heaters 23 according to the first through fifth exemplary embodiments, the heat generating resistor 26 has two different stages of the edge areas 26*a* and 26*b* having a low resistance and the center area 26*c* having a high resistance. However, the number of stages of the resistance values of areas of the heat generating resistor 26 is not limited to two.

Figure 10:
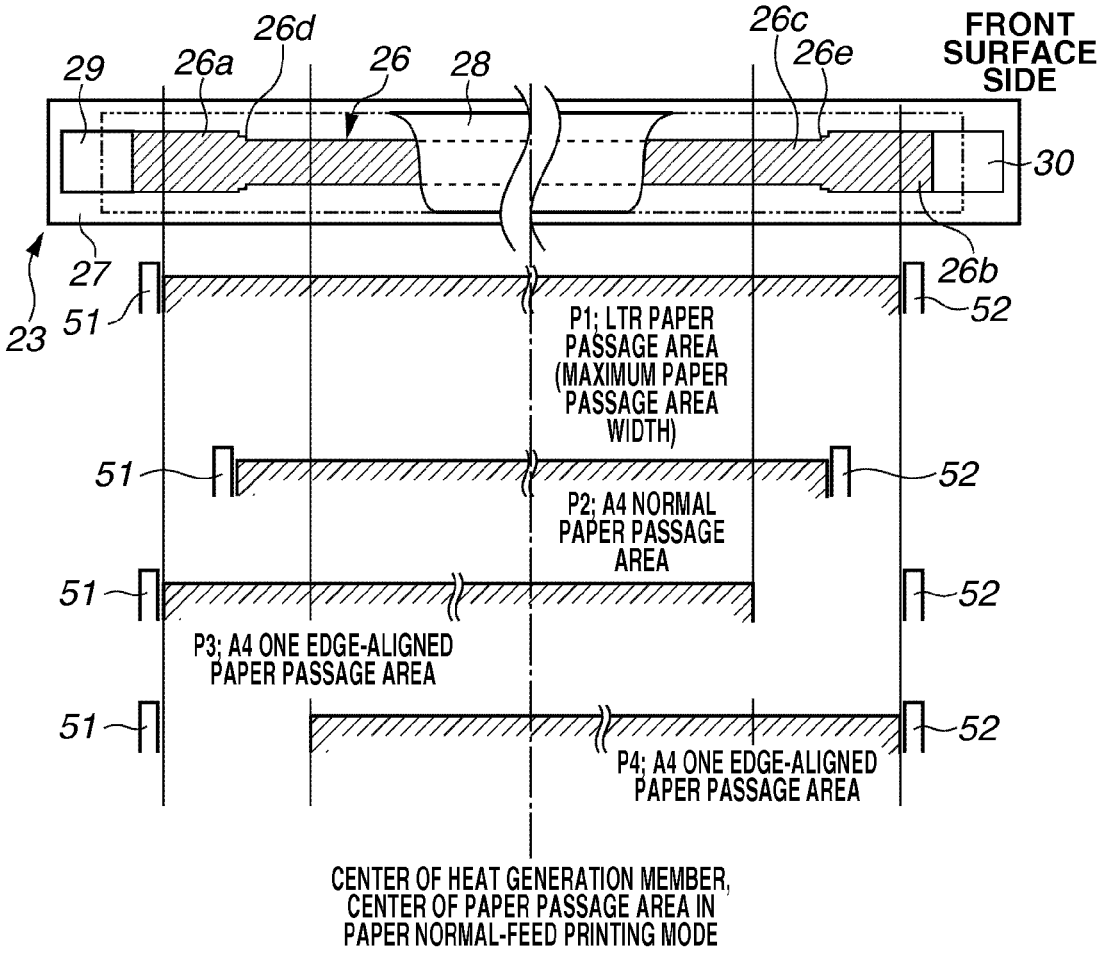
FIG. 10 illustrates a practical example of a heater according to the first through fifth exemplary embodiments of the present invention.
Figure 11:
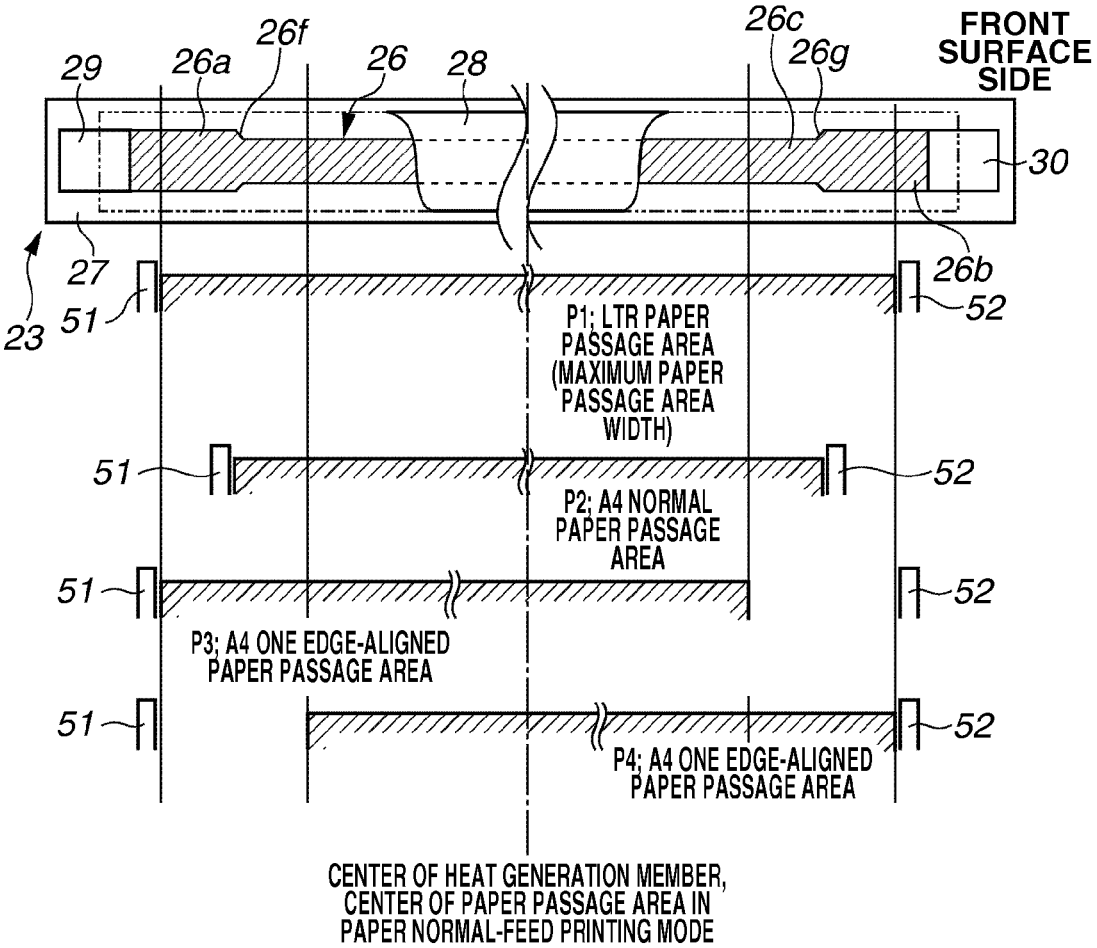
FIG. 11 illustrates a practical example of a heater according to the first through fifth exemplary embodiments of the present invention.

More specifically, it is also useful if areas 26*d* and 26*e* (FIG. 10) having different resistance values per unit length are connected so that the resistance values may vary at multiple stages. Furthermore, it is also useful if areas 26*f* and 26*g* (FIG. 11) are connected so that the electrical resistance per unit length may gradually vary.

As described above, in another aspect of the present invention, the effect similar to those of the above-described first through fifth exemplary embodiments can be implemented by gradually changing the resistance per unit length of the heat generating resistor 26 at multiple stages according to the size of the recording paper.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-276985 filed Oct. 28, 2008, which is hereby incorporated by reference herein in its entirety.

What is claimed is:

1. An image forming apparatus configured to form a toner image on a recording paper, the image forming apparatus comprising:

an image forming unit configured to form an unfixed toner image on the recording paper;

a paper feed unit configured to feed the recording paper to be conveyed into the image forming unit, wherein the paper feed unit includes two recording paper position regulation members configured to regulate a movement of the recording paper in a direction perpendicular to a conveyance direction of the recording paper, each of the two recording paper position regulation members, whose position is adjustable according to a width of the recording paper, is provided at each side of the recording paper; and a fixing unit configured to fix the unfixed toner image formed on the recording paper thereon, wherein the fixing unit includes:

an endless film;

a single heater including a single heat generating resistor on a substrate thereof and configured to be in contact with an inner surface of the endless film; and a pressure member configured to form a fixing nip portion with the heater via the endless film, wherein a length of the heat generating resistor in the direction perpendicular to the conveyance direction is longer than a width of a first size recording paper, which has a width that is the greatest of widths of standard size recording papers that can be used on the image forming apparatus, wherein in the direction perpendicular to the conveyance direction, a resistance of the heat generating resistor per unit length is smaller in an edge area than in a center area, and the resistance of the heat generating resistor in the edge area enables sufficient fixing of the unfixed toner image on the first size recording paper, wherein if a second size recording paper, whose width is the greatest of the widths of the standard size recording papers except for the width of the first size recording paper, is fed in a state where one edge of the second size recording paper is in contact with one of the two recording paper position regulation members when the two recording paper position regulation members are set at a position for feeding the first size recording paper, a boundary position of the heat generating resistor at which the resistance varies is set within an area between a position of the other edge of the second size recording paper and a position of the other recording paper position regulation member, wherein the heater generates a quantity of heat in the direction perpendicular to the conveyance direction while the first size recording paper is conveyed at the fixing nip portion that is substantially the same as a quantity of heat in the direction perpendicular to the conveyance direction while the second size recording paper is conveyed at the fixing nip portion, and wherein a same conveyance speed and a same paper-to-paper distance are used for the first size recording paper and the second size recording paper.

2. The image forming apparatus according to claim 1, wherein a width of the first size recording paper (e), a width of the second size recording paper (f), a length of the heat generating resistor in a longitudinal direction (a), a length of the edge area (b), a resistance value of the center area per unit length (c), and a resistance value of the edge area per unit length (d) satisfy a relationship expressed by the following expression:

$$5.4 \leq b \times (d/c) + \{a/2 - (f - e/2) - b\} \leq 6.4.$$

3. The image forming apparatus according to claim 1, wherein the resistance of the heat generating resistor per unit length is adjusted according to the width of the heat generating resistor in the substrate lateral direction.

4. The image forming apparatus according to claim 1, wherein the resistance of the heat generating resistor per unit length is adjusted according to the thickness of the heat generating resistor in the substrate lateral direction.

5. The image forming apparatus according to claim 1, wherein a material of the substrate is alumina.

6. The image forming apparatus according to claim 1, wherein the first size recording paper is an A3 size paper and the second size recording paper is a ledger size paper.

7. The image forming apparatus according to claim 1, wherein a same conveyance speed and a same paper-to-paper distance are used for the first size recording paper and the second size recording paper.

8. An image forming apparatus configured to form a toner image on a recording paper, the image forming apparatus comprising:

an image forming unit configured to form an unfixed toner image on the recording paper;

a paper feed unit configured to feed the recording paper to be conveyed into the image forming unit, wherein the paper feed unit includes two recording paper position regulation members configured to regulate a movement of the recording paper in a direction perpendicular to a conveyance direction of the recording paper, each of the two recording paper position regulation members, whose position is adjustable according to a width of the recording paper, is provided at each side of the recording paper; and a fixing unit configured to fix the unfixed toner image formed on the recording paper thereon, wherein the fixing unit includes:

an endless film;

a single heater including a single heat generating resistor on a substrate thereof and configured to be in contact with an inner surface of the endless film; and a pressure member configured to form a fixing nip portion with the heater via the endless film, wherein a length of the heat generating resistor in the direction perpendicular to the conveyance direction is longer than a width of a first size recording paper, which has a width that is the greatest of widths of standard size recording papers that can be used on the image forming apparatus, wherein in the direction perpendicular to the conveyance direction, a heat generating quantity of the heat generating resistor per unit length is smaller in an edge area than in a center area, and the heat generating quantity of the heat generating resistor in the edge area enables sufficient fixing of the unfixed toner image on the first size recording paper, wherein if a second size recording paper, whose width is the greatest of the widths of the standard size recording papers except for the width of the first size recording paper, is fed in a state where one edge of the second size recording paper is in contact with one of the two recording paper position regulation member when the recording paper position regulation members are set at a position for feeding the first size recording paper, a boundary position of the heat generating resistor at which the heat generating quantity varies is set within an area between a position of the other edge of the second size recording paper and a position of the other recording paper position regulation member, wherein the heater generates a quantity of heat in the direction perpendicular to the conveyance direction while the first size recording paper is conveyed at the fixing nip portion that is substantially the same as a quantity of heat in the direction perpendicular to the conveyance direction while the second size recording paper is conveyed at the fixing nip portion, and wherein a same conveyance speed and a same paper-to-paper distance are used for the first size recording paper and the second size recording paper.

9. The image forming apparatus according to claim 8, wherein a width of the first size recording paper (e), a width of the second size recording paper (f), a length of the heat generating resistor in a longitudinal direction (a), a length of the edge area (b), a resistance value of the center area per unit length (c), and a resistance value of the edge area per unit length (d) satisfy a relationship expressed by the following expression:

$$5.4 \leq b \times (d/c) + \{a/2 - (f - e/2) - b\} \leq 6.4.$$

10. The image forming apparatus according to claim 8, wherein a material of the substrate is alumina.

11. The image forming apparatus according to claim 8, wherein the first size recording paper is a letter size paper and the second size recording paper is an A4 size paper.

12. The image forming apparatus according to claim 8, wherein the first size recording paper is an A3 size paper and the second size recording paper is a ledger size paper.

* * * * *